US005366592A

United States Patent [19]

Ford

[11] Patent Number: 5,366,592

[45] Date of Patent: Nov. 22, 1994

[54] DIGESTER SAMPLING DEVICE

[75] Inventor: Jerry C. Ford, Fernandina Beach, Fla.

[73] Assignee: ITT Rayonier Inc., Stamford, Conn.

[21] Appl. No.: 960,483

[22] Filed: Oct. 9, 1992

[51] Int. Cl.[5] ..... D21C 7/12

[52] U.S. Cl. ..... 162/49; 162/198; 162/263; 73/863.86

[58] Field of Search ..... 162/198, 49, 263; 73/863.86, 863.11, 863.01

[56] References Cited

U.S. PATENT DOCUMENTS 2,746,297 8/1953 Martin ..... 162/263
3,659,461 5/1972 Thompson ..... 73/422 R
4,341,124 7/1982 Rodgers et al. ..... 73/863.01
4,540,468 9/1985 Genco et al. ..... 162/49

OTHER PUBLICATIONS

Paulonis et al. "Kappa Numbers & Overall Yield Calc. Based on Digester Liquor Analysis", Nov. 1988, Tappi Journ., pp. 185–187.

*Primary Examiner*—W. Gary Jones
*Assistant Examiner*—Dean T. Nguyen
*Attorney, Agent, or Firm*—Fred A. Keire; William J. Spatz; Robert Winkle

[57] ABSTRACT

A sampling device for a batch or continuous pulp digester for reduction of pulp sampling errors such as during a digester "blow" and for improving a pulping process based on the obtained samples.

5 Claims, 5 Drawing Sheets

| STEP | 19 | 20 | 21 | 22 | PURPOSE |
|---|---|---|---|---|---|
| 1 | OPEN | CLOSED | OPEN | OPEN | CLEAR VALVE C TO DIGESTER |
| 2 | OPEN | OPEN | OPEN | CLOSED | TAKE SAMPLE |
| 3 | OPEN | CLOSED | OPEN | OPEN | CLEAR VALVE C TO DIGESTER |
| 4 | OPEN | OPEN | CLOSED | OPEN | CLEAR VALVE B TO SAMPLER |
| 5 | CLOSED | CLOSED | CLOSED | CLOSED | SEQUENCE COMPLETE |

| STEP | 19 | 20 | 21 | 22 | PURPOSE |
|---|---|---|---|---|---|
| 1 | OPEN | CLOSED | OPEN | OPEN | CLEAR VALVE C TO DIGESTER |
| 2 | OPEN | OPEN | OPEN | CLOSED | TAKE SAMPLE |
| 3 | OPEN | CLOSED | OPEN | OPEN | CLEAR VALVE C TO DIGESTER |
| 4 | OPEN | OPEN | CLOSED | OPEN | CLEAR VALVE B TO SAMPLER |
| 5 | CLOSED | CLOSED | CLOSED | CLOSED | SEQUENCE COMPLETE |

DIGESTER SAMPLING DEVICE

This invention relates to wood pulping, more specifically, this invention relates to a process for controlling the quality of wood pulp by an improved operation of a wood pulp digester; more particularly, this invention relates to a wood pulp digester sampling device and a method for operating a sampling device. Still further this invention relates to a method for removing variability in wood pulp sampling process during a wood pulp digester blow.

BACKGROUND FOR INVENTION

When operating a wood pulp digester it is important to know the various factors for the control of the wood chip cooking process. Such control is necessary to adjust the digester cooking conditions based on the test results which have been obtained from a previous batch. Thus, in a feed-back manner, the tests which have been obtained from a previous batch of wood pulp during a discharge or a "blow" of the wood pulp from a digester are then used to adjust the next batch. Typically, representative samples for laboratory testing are obtained during the discharge cycle of a digester known as a "digester blow". A digester blow lasts about 10 to 15 minutes, typically 12 to 14 minutes and a sample is typically obtained at about 2 minutes from start of a blow at an interval from about 1 minute to about 5 minutes. A typical sample gathering cycle is about 2 minutes throughout the digester blow cycle.

When the samples are conventionally obtained, these show a large variability between the various samples taken at different times from the same digester blow. Replicate testing however on the same sample indicates that the variability of the testing itself is quite small.

It is also known that large industrial digesters digest wood pulp in an inhomogenous manner throughout the chip mass. Infrequent sampling or a single sample obtained during the digester blow cycle represent only a small portion of the batch. Typically, it has been sought to minimize the unrepresentative sampling by taking a composite multiple grab sample over equal increments of time while the batch is being discharged from the digester vessel i.e. during a digester blow. However, unreliable readings are introduced since individuals introduce unacceptable variations in the procedure by their own sampling techniques. Moreover, as the act of sampling itself causes unwanted expelling of gases and hot digester liquor, i.e. digester effluents, the hazards are now ameliorated or minimized in a mill operation employing the novel sampling device.

PRIOR ART

The prior art known to the inventor is that found in a typical mill application. A sampling is performed in a prescribed manner by manually operating i.e., opening and shutting a valve such as a valve appropriately located near the bottom of the digester. A wood pulp fiber sample is selected from a sample blown against a target during the sampling cycle. Typically, targets are fixed metal plates which contribute to the disintegration of the cooked wood chips. Conventionally, four samples are sought to be taken during the digestive blow and a composite formed to obtain a representative sample for analysis.

Inasmuch as individual's own sampling procedure introduces variables, uncontrolled variations in the sampling process occur. Thus, gross adjustments to a wood pulping process are often based on erroneous sampling results. Results occur that have gross degrees of variation in the next batch of wood chips being subjected to digestion. Subsequent digester operation thus result in fairly wide swings in pulp properties from the uncontrolled variations in the sampling process or produce randomly uncontrolled variations in the digestion process itself.

In other mills, representative samples have been sought from a single sample obtained from the blow pit or blow tank. In tests conducted on samples obtained from a blow pit, these tests did not provide a predictable, representative sample of the average of the samples taken from the digester during the blow.

BRIEF DESCRIPTION OF THE INVENTION

In accordance to the invention, it has been found that if properly obtained pulp samples are secured from a wood pulp digester during the digester blow, then improved sampling and testing provide means for operating a wood pulp digester in a more predictable, advantageous, and improved manner. Further, a novel sampling device operated in conjunction with a wood chip digester provides improved sample selection. An improved method for sampling has resulted in a reduction in the variability of wood pulp samples obtained during a digester blow. Thus an improved method for wood pulp digester blow sampling has now been found to be advantageous for improving pulp quatity. Still further a method for operating a sampling device in a given sequence has provided improved sampling results. These and other advantages of the present invention will now be further described.

DETAILED DESCRIPTION OF THE DRAWINGS AND THE EMBODIMENTS OF THE PRESENT INVENTION

With reference to the drawings illustrating the present invention and the various embodiments thereof:

Figure 1:
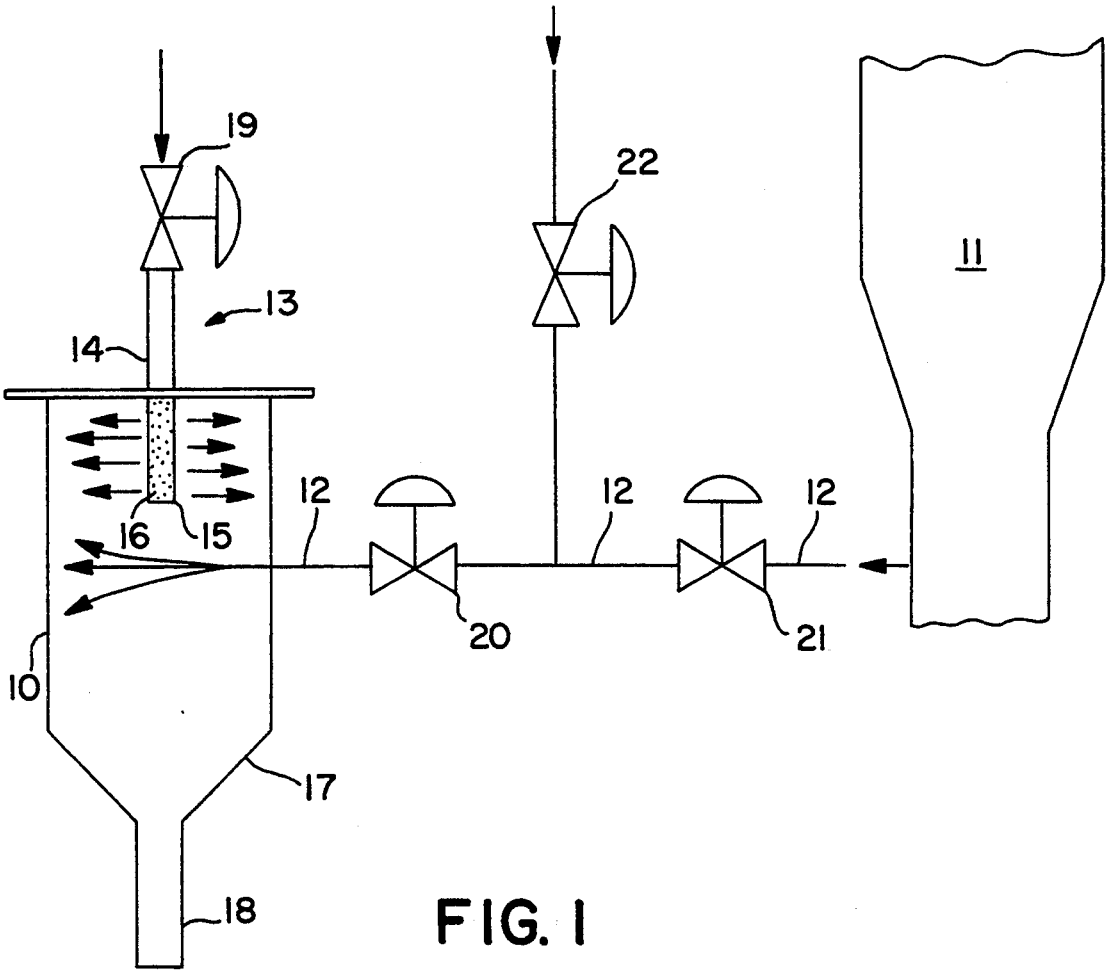
FIG. 1 shows a schematic arrangement of a sampling device in combination with a digester.

As shown in FIG. 1, the sampling device flash vessel 10 is used in combination with a digester 11. The volume of a flash vessel is about 6,500 cubic inches but may be larger or smaller. The flash vessel 10 has a pipe 12 by which the pulp sample is blown from the digester 11 via pipe 12 into the flash vessel 10. Typical operating conditions for a digester are: pressure of about 100 psig; temperature (upper or maximum) is dependant on the grade of pulp being produced but ranges from about 130° C. to about 150° C. A quench medium, i.e. water spray injection means 13 is fixed on the top of the vessel 10 to condense the vapors evolving from the flashing blow sample and to wash the pulp fibers down the walls of the vessel 10. For the above vessel quench water flow is about 30 gallons per minute, but the amount may be varied to suit the conditions. The injection means 13 is in form of a pipe 14, having at the end thereof a spray head 15 which contains a number of holes 16 for discharging water injected into flash vessel 10. A conical bottom 17 is provided for flash vessel 10. A discharge pipe 18 leads from the vessel 10 to a sample catch device in the form of a wire basket 23. The operation of valves 19, 20, 21, and 22 will be described in conjunction with the predetermined sampling sequence described in FIG. 8 herein.

Figure 2:
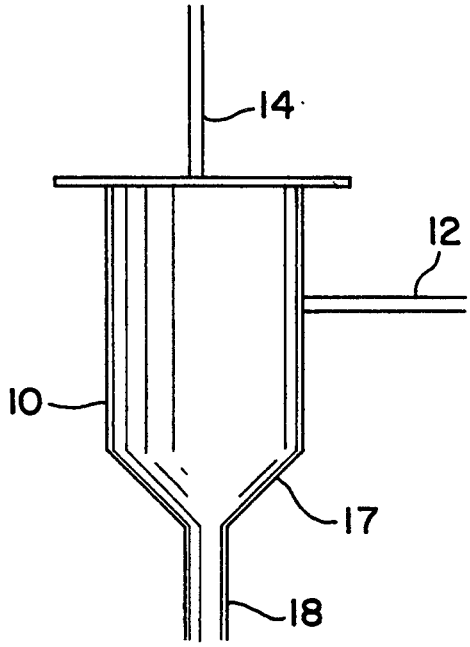
FIG. 2 shows a side elevation of a digester sample flash vessel schematically illustrated in FIG. 1.
Figure 3:
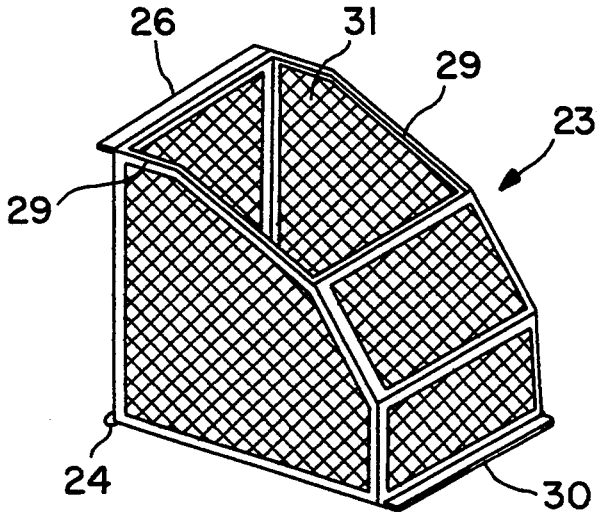
FIG. 3 shows a pulp sample wire basket used in combination with digester sample flash vessel shown in FIG. 2.
Figure 4:
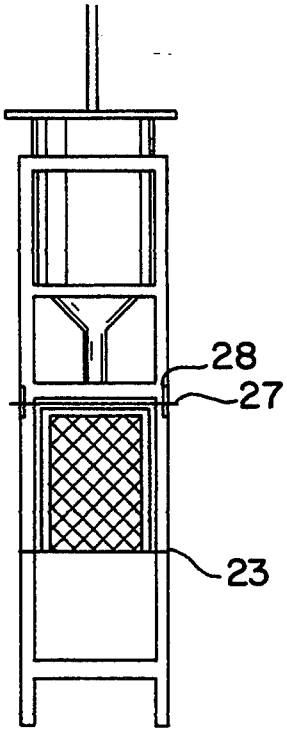
FIG. 4 illustrates a front elevation of the combination of the flash vessel and sample wire basket.
Figure 5:
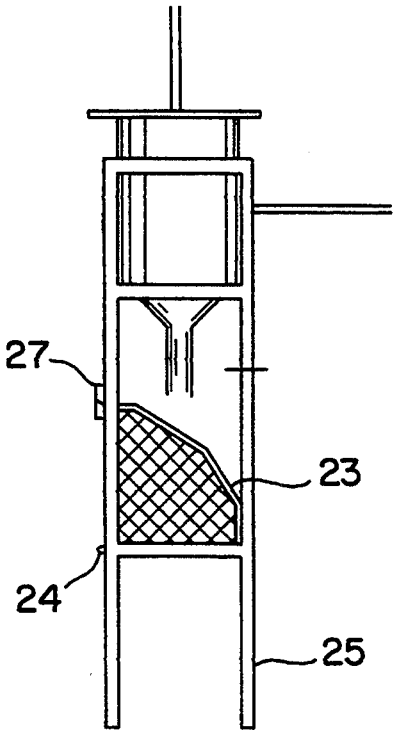
FIG. 5 shows a side elevation of the flash vessel and sample basket shown in FIG. 4.
Figure 6:
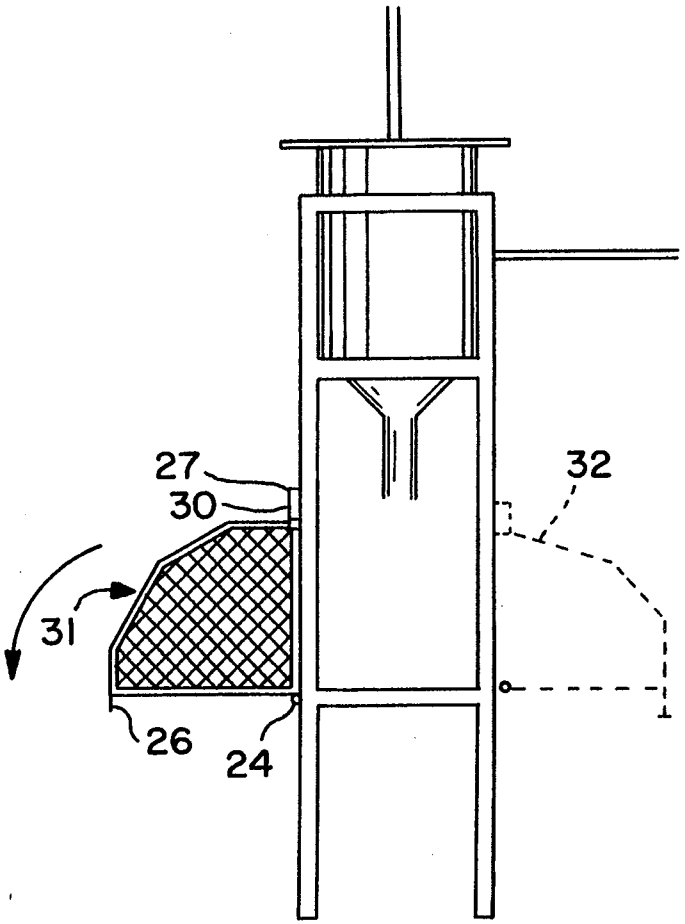
FIG. 6 shows a side elevation shown in FIG. 5 with a basket in position for blending and gathering a sample.

A fiber sample is collected in the wire basket 23 positioned under the discharge pipe 18 as shown in FIGS. 2 and 3. The wire basket 23 has a pivot shaft 24 shown in FIGS. 3 to 7. The wire basket 23 is pivotable out of the sampler frame 25 by pulling on the upper handle 26 and held in place by a latching bar 27. The spring loaded latching bar 27 is attached on both sides of the front of the frame 25 by two D-brackets 28. The latching bar rides over the top rails 29 of the wire basket 23 as it is pivoted out of the frame 25. After the wire basket 23 has rotated about 90 degrees, the bottom handle 30, on the bottom rear of the wire basket 23, is blocked by and held in place by the latching bar 27 as shown in FIG. 6.

Figure 7:
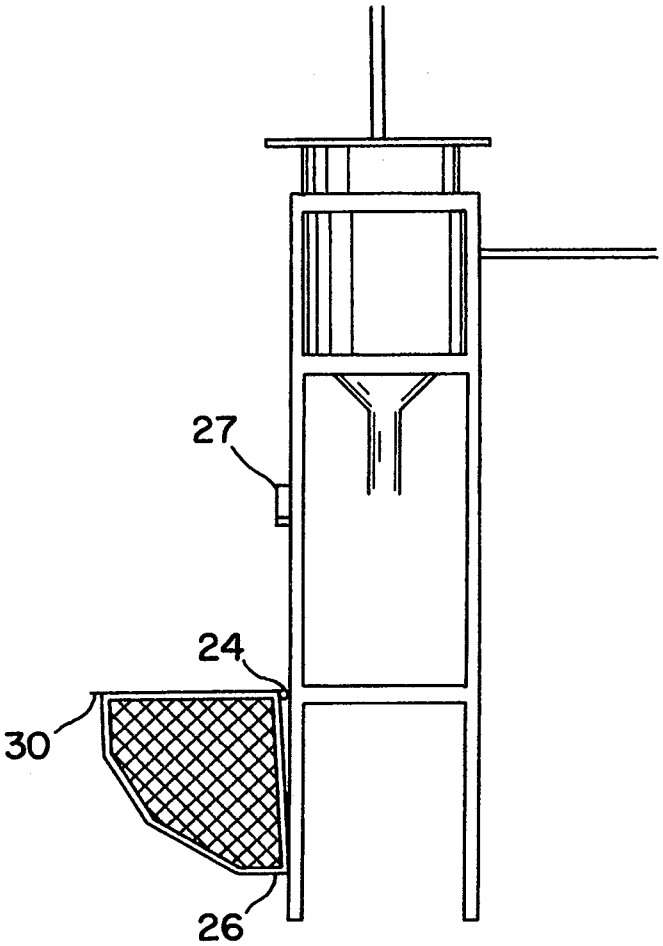
FIG. 7 shows the device in FIG. 5 in a further sample discharge position during the operating cycle.

The wire basket 23 is held in this position while a technician obtains a fiber sample through the wire basket opening 31. When a technician lifts the latching bar to release the rear handle 30, the basket pivots into an inverted position discharging the excess material as shown in FIG. 7. After cleaning, the wire basket 23, is returned to its ready position inside the frame 25. The pivot shaft 24 may also be latched (not shown) to allow complete removal of wire basket 23.

While in FIGS. 4 to 7 only one wire basket 23 has been shown, it is possible to mount up to four wire baskets 23 in the square frame 25. A second wire basket 32 has been shown in phantom lines to illustrate this embodiment. Likewise, more than one flash vessel 10 and the required, accompanying devices may be coupled to a digester 11 to allow multiple sample obtention in a facile and quick succession.

Accordingly, if the wire basket 23 and 32 are operated automatically such as e.g. by a pneumatic cylinder means (not shown) to place in position for sampling and to remove wire basket 23 after a sample has been obtained (including pneumatically driven latching means), a sampling sequence may take place without a technician's assistance during a sampling and each sample may be taken away after a digester blow has been completed. As an added benefit, the entire sampling device i.e., flash vessel 10 and wire baskets 23 and 32 with the necessary frame 25, may be housed in an enclosure (not shown) which prevents any significant amount of digester blow gases, i.e. digester effluent from escaping into the environment, e.g., the entire enclosure may be appropriately evacuated such as by vacuum means (not shown) and then sent to a scrubber (not shown).

Figure 8:
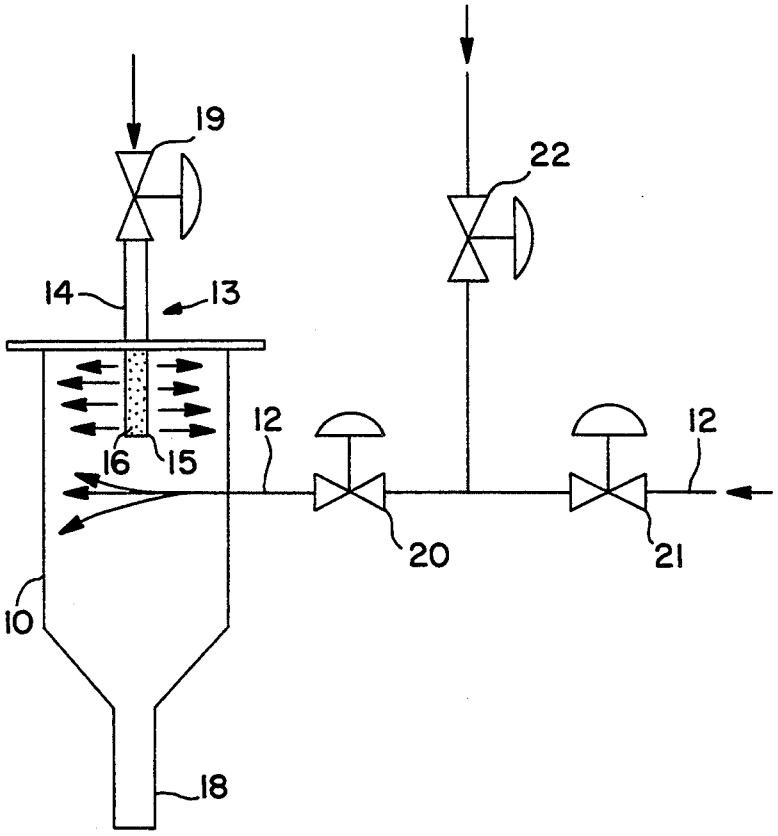
FIG. 8 illustrates the schematic arrangement of valves shown in FIG. 1 in conjunction with a table showing the sequencing of the automatic valves for obtaining a proper pulp sample from a blow pit or pot during a digester blow cycle.

A significant benefit has been found to be the automation of the valves shown in the schematic in FIGS. 1 and 8 including the sequencing shown in the table for FIG. 8. The initial step in the sample sequence is the opening of the quench water valve 19; in this embodiment, the valve is a 1½ inch electrically operated ball valve. As mentioned before, the amount of quench water may be varied but is about 30 gallons per minute. Next the steam valve 22, which in this illustration is a one inch pneumatically operated ball valve, and the digester blow line valve 21 are opened and the sample line 12 is cleared back into the digester 11. The sample valves in this illustration are also one inch pneumatically operated ball valves. Then the steam valve 22 is closed, the sample valve 20 opened for the one second, and a pulp sample, because of the pressure in the digester, is passed from the digester 11 to the flash vessel 10 via pipe 12. To complete the cycle, the fibers remaining in the sample pipe 12 are blown alternatively back into the digester 11 or to the flash vessel 10, when the steam valve 22 is opened and either valve 21 is opened or it is closed and valve 20 is opened. Conditions in the steam line are illustrative only and are as follows 150 psig steam with approximately 100° F. of super heat for a typical temperature of about 450° F. The above conditions, of course, may be varied and are typically varied and therefore are intended for purposes of illustration only.

The sampling sequence is repeated for as many times as necessary to obtain a representative pulp sample for subsequent analysis; or each sample may be analyzed for statistically controlling the pulping process. As an example, the first sample is taken two minutes after the beginning of the digester blow for three to five times total (typically five times) at two minute intervals after the first sample is taken. The sampling process maybe established by an appropriate schedule as designed for a particular digester or as formed by experience. The sampling device may also be purged by steam via valve 22 and the quench medium via valve 19 by opening valve 20.

A flashing light (not shown) over the sampling device may be provided while the sampling sequence is in progress. The light burns steadily when the sequence is complete to tell the technician which digester has blown and requires a sample to be taken. A switch (not shown) mounted to the front of the sample frame may be provided to electrically disconnect the sample valve 20 and keep it in a closed position thereby preventing an accidental exposure to hot materials.

The major variables that are controlled in a pulping process are the average degree of polymerization or molecular weight of the cellulose molecules as measured by the intrinsic viscosity test and the amount of residual lignin remaining in the fibers as measured by the K-Number or Kappa Number tests. Typically a grade of wood pulp will have in process specification targets and limits for these two variables. Testing for these properties is typically performed on every batch, or at fixed time intervals for continuous processes, and the results of the laboratory analyses are used to adjust the process variables of digesters in progress. The major process variables in digestion of wood chips by the acid sulfite process include:

1. The strength of the cooking acid both true free and combined sulfur dioxide.
2. The maximum temperature of the batch.
3. The elapsed time to achieve the maximum temperature.
4. The elapsed time at the maximum temperature.
5. The elapsed time for the step of relieving the pressure from the digester.

For batch digesters in progress, the main process variables which are adjusted based on the laboratory test results are the elapsed time at the maximum temperature and the elapsed time for relieving the digester pressure. For continuous digesters both the maximum temperature and the strength of the cooking acid can be adjusted based on the laboratory results.

The herein disclosed sampling system has been used to obtain more representative digester samples. The more reliable test information attained has provided the basis for reducing the variability of these important parameters. The standard deviation of the Cook Intrinsic Viscosity test has been reduced to 0.409 compared to 0.431 for the period prior to the installation of the sampling devices. Similarly the standard deviation of the Cook K-Number test has been reduced to 1.95 compared to 2.24 for the period prior to the samplers. The reduction in both of these parameters has resulted in significant improvements in the ease and cost of the down stream processing steps. This has improved both the quality of the final product and cost of the final product. In accordance with the pulp and paper industry practices, tests for the above variables are the conventionally employed TAPPI methods of analyses.

To sum up, the removal of the sources of variability in cooking as obtained from rigorous sampling and analysis ultimately leads to less variability in the final product with resultant greater acceptance of the higher quality pulp in the market place. By the described combination, the effects of sampling variability have been reduced and better pulp quality has been achieved. Further, safety for operating personnel is given more consideration and the environmental disadvantages due to sampling are abated by the reduction and/or containment of the digester effluent. With the previous manual technique, the mixture of steam and sulfur dioxide gas, as it flashed from the sample, were deleterious and required a technician to wear suitable gear. The deleterious gases are now quenched in the novel device and, in fact, for a described embodiment a technician does not have to be present for the actual sampling.

Various and other benefits should be readily evident from the description of the invention and the various embodiments thereof. These are not intended to limit the invention which is defined by claims which follow.

I claim:

1. A wood pulp sampling device for obtaining a sample wood pulp from a wood chip digester comprising:

a conduit from a digester;

an array of valve means comprised of individual valve means on said conduit for sequentially opening and closing said individual valve means, said array of valves comprising at least a first valve means for clearing said conduit from said digester;

a second valve means for opening and closing said conduit from said digester; and a third valve means for opening and closing said conduit for ingress of a pulp sample from said digester into a flash vessel means;

said flash vessel means interconnected via said conduit with said digester comprising an outlet means and a quench means;

said quench means for said flash vessel means comprising a quench medium conduit; a quench medium injecting means for injecting a quench medium into said flash vessel means; and a quench medium valve means, said array of valve means of individual valve means and quench medium valve means sequentially operably, interconnected with said digester and said flash vessel means; wherein the array of valve means further comprises a valve control means for said first, second and third valve means sequentially opening and closing in a predetermined manner; and means for catching a sample of wood pulp from said outlet for said flash vessel means.

2. The wood pulp sampling device as defined in claim 1 including a containment means for said sampling device for containment of volatile digester effluents.

3. The wood pulp sampling device as defined in claim 1 comprising a pluralitity of removably operable sample catch means for catching a wood pulp sample.

4. The wood pulp sampling device as defined in claim 1, wherein the valve control means for activating the first, second and third valve means also activates the quench medium valve means in conjunction with the first, second and third valve means.

5. The wood pulp sampling device as defined in claim 1, wherein the means for catching a sample of wood is rotatably mounted to said outlet.

* * * * *